US006394589B1

(12) United States Patent
Willus et al.

(10) Patent No.: US 6,394,589 B1
(45) Date of Patent: May 28, 2002

(54) INK JET PRINTHEAD WITH REDUCED CROSSTALK

(75) Inventors: Charles A. Willus, Newtown; Stuart D. Howkins, Ridgefield, both of CT (US); Nobuhiro Noto; Yoshitaka Akiyama, both of Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/451,919

(22) Filed: Dec. 1, 1999

(51) Int. Cl.[7] ..... B41J 2/045; B41J 2/17
(52) U.S. Cl. ..... 347/68; 347/94
(58) Field of Search ..... 347/68, 94, 85

(56) References Cited

U.S. PATENT DOCUMENTS 4,146,899 A * 3/1979 Paranjpe et al. ..... 347/47
4,463,362 A * 7/1984 Thomas ..... 347/86
4,809,024 A * 2/1989 DeYoung et al. ..... 347/94

FOREIGN PATENT DOCUMENTS

DE G9011817.0 8/1990
JP 01308644 12/1989
JP 07137262 5/1995
JP 07329301 12/1995
WO WO98/43050 10/1998

* cited by examiner

*Primary Examiner*—Thinh Nguyen
(74) *Attorney, Agent, or Firm*—Pillsbury Winthrop LL

(57) ABSTRACT

An ink jet printhead composed of: a reservoir storing a quantity of printing ink, an ink manifold defining an ink supply volume in communication with the reservoir for holding a supply of ink received from the reservoir and a plurality of individually controlled ink jet delivery channels, each of the channels having an ink drop ejection transducer and an orifice to eject successive ink drops on demand in response to pressure pulses produced by the transducer, and each of the channels being in communication with the ink supply volume for receiving ink from the ink supply volume. The manifold is constructed to give the ink supply volume a large acoustic compliance to minimize propagation of pressure disturbances in the ink supply volume and acoustic signal crosstalk between the channels.

14 Claims, 4 Drawing Sheets

INK JET PRINTHEAD WITH REDUCED CROSSTALK

BACKGROUND OF THE INVENTION

The present invention relates to inkjet printheads in which ink in the liquid state is delivered to a plurality of nozzles and ink drops are ejected on demand from each nozzle in response to actuation of an associated ejection transducer.

Ink jet printers are widely used for printing documents in both the office and the home, as well as for industrial printing applications on a variety of surfaces. Such printers include an ink jet printhead having a plurality of ink ejection chambers, or channels, each containing one or more ink jet ejection orifices, or nozzles. The ejection of ink from each nozzle is controlled by a pattern of pressure pulses.

Each nozzle constitutes the outlet end of an ink delivery channel. The inlet ends of all of the channels communicate with an ink supply volume formed within an ink manifold. As ink is withdrawn from the manifold, it is replaced by fresh ink from a reservoir that is in communication with the manifold. The printhead is designed so that the ink supply volume is always filled with ink.

The pressure pulses for ejecting ink from each nozzle are produced by an associated ink jet ejection transducer. The transducer, in turn, is responsive to electrical drive pulses produced by a print engine.

When a pressure pulse is generated within a channel, one part of the resulting pressure disturbance acts to eject an ink drop from the associated nozzle while another part of the resulting pressure disturbance is propagated in a backward direction through the channel and into the ink supply volume within the manifold. Pressure disturbances which enter the ink supply volume are transmitted acoustically throughout the ink supply volume.

As a result, a time varying manifold pressure, known as crosstalk, will influence the pressure in all of the other channels. This will affect the flow dynamics within all of the channels. In particular, crosstalk can cause variations to occur in the velocity, shape and/or size of the ink drops ejected from the nozzles of the other channels and such variations will have an adverse effect on the quality of the resulting printed material.

BRIEF SUMMARY OF THE INVENTION

It is an object of the present invention to minimize the transmission of pressure disturbances, or crosstalk, between the channels of a printhead of the type described above.

The invention is embodied in an ink jet printhead comprising: a reservoir storing a quantity of printing ink; at least one ink manifold defining an ink supply volume in communication with the reservoir for holding a supply of ink received from the reservoir; and a plurality of individually controlled ink jet delivery channels, each of the channels having an ink drop ejection transducer and an orifice to eject successive ink drops on demand in response to pressure pulses produced by the transducer, and each of the channels being in communication with the ink supply volume for receiving ink from the ink supply volume, wherein the manifold is constructed to give the ink supply volume a large acoustic compliance to minimize propagation of pressure disturbances in the ink supply volume and acoustic signal crosstalk between the channels.

The invention is applicable to any existing type of printhead, including those of the bubble jet type.

DETAILED DESCRIPTION OF THE INVENTION

Figure 1:
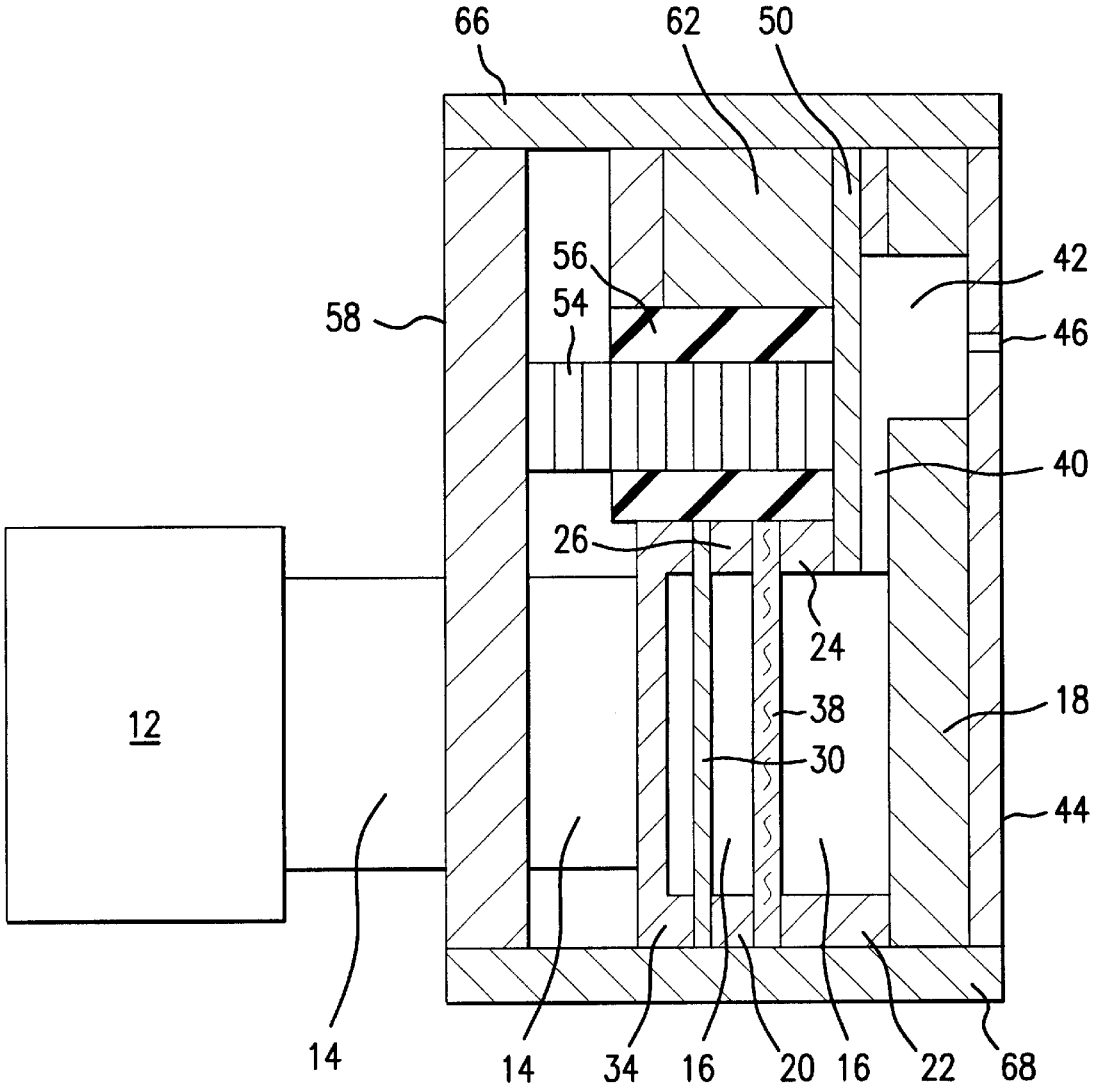
FIG. 1 is a cross-sectional view of a printhead according to a preferred embodiment of the present invention.

FIG. 1 is a cross-sectional view of an inkjet printhead which utilizes hot-melt inks with properties (surface tension, viscosity, density etc.) in a certain range. However, the invention can be applied to printheads using any ink having properties in the design range and being chemically compatible. The basic components of the printhead include, as will be described in greater detail below, a reservoir 12 holding a supply of ink, a manifold which receives ink from the reservoir and which remains filled with ink until the reservoir supply has been exhausted and a plurality of individually controlled ink jet delivery channels, each ending in a nozzle from which successive ink drops can be ejected.

Referring more specifically to FIG. 1, reservoir 12 is coupled to the interior of a manifold via an ink supply conduit 14.

The manifold provides an ink supply space, or volume, 16 delimited, or enclosed, by a chamber plate 18, wall members 20, 22, 24 and 26 and a thin plate 30. Plate 30 is supported by further wall member 34.

A filter 38 extends across space 16, and conduit 14 is in communication with the portion of space 16 that is located between filter 38 and plate 30.

The printhead further includes a plurality of delivery channels each of which has an inlet end communicating with space 16. The plurality of channels are arranged in a stack perpendicular to the plane of FIG. 1, the elements of one of these channels being visible in FIG. 1. Each channel includes an inlet path 40 and an outlet chamber 42. Outlet chamber 42 is bounded by an orifice plate 44 in which is formed a plurality of nozzles, or ink ejection orifice, 46. Each chamber 42 communicates with a single nozzle 46.

Each delivery channel further includes a diaphragm 50 located at the side of chamber 42 that is remote from nozzle 46. Diaphragm 50 is coupled to a respective transducer 54 that may be a piezoelectric transducer composed of a stack of piezoelectric plates. Transducer 54 is enclosed by silicone members 56. Each transducer 54 is sandwiched between an associated diaphragm 50 and a ceramic plate 58 that is common to all channels. Electrodes (not shown) are connected in a conventional manner to each transducer 54 via passages (not shown) provided in plate 58.

The printhead is completed by a member 62 that serves to support a portion of members 34 and 56 and diaphragm 50, along with two side plates 66 and 68 that form parts of the housing for the printhead.

It will be noted that in the illustrated embodiment, the ink manifold has an inlet in communication with reservoir 12 and outlets in communication with inlet paths 40 of the delivery channels, and the ink manifold outlets are spaced from the ink manifold inlet in the direction of ink flow through the manifold. Wall 30 extends generally perpendicular to the direction of ink flow through space 16. However, wall 30 can have other orientations relative to the direction of ink flow through the manifold, provided that it forms one boundary wall of space 16. In addition, wall 30, which constitutes one of the surfaces bounding space 16, preferably has an area at least as large as the area of any other one of the surfaces bounding space 16.

When a drop of ink is to be ejected from any one orifice 46, an electrical actuation pulse is applied to transducer 54, causing the transducer to expand momentarily and deflect diaphragm 50. The deflection of diaphragm 50 creates a pressure pulse in chamber 42 and this pulse acts to eject a drop of ink from orifice 46.

A portion of the energy of the pressure pulse produced by deflection of diaphragm 50 is propagated as a pressure disturbance via inlet path 40 into space 16, where it will influence the pressure in the other ink jet delivery channels.

According to the present invention, the propagation of pressure disturbances between ink jet deliver channels is prevented, or at least substantially minimized, by giving the manifold, or more specifically space 16, a high fluidic compliance. In the illustrated embodiment, this is achieved by forming plate 30 to be sufficiently flexible to minimize the pressure disturbances that are propagated into space 16.

According to one preferred embodiment of the invention, this is achieved by forming plate 30 as a stainless steel sheet having a thickness on the order of 12 $\mu$m, although smaller thicknesses can be envisioned. The degree of compliance increase afforded by the present invention is influenced by the mechanical characteristics of both plate 30 and filter 38.

As a general rule, the compliance increase afforded by the present invention will be inversely proportional to the thickness of plate 30. A thickness less than 12 $\mu$m may prove advantageous if such a thickness proves to be feasible in practice.

Filter 38 may be made of stainless steel, nickel, etc., an electroformed nickel material presently being preferred. Because of the necessary position of filter 38 in space 16, the compliance of filter 38 will influence the compliance the manifold. The compliance of filter 38 will depend on the size and number of the ink passages therein, which are determined by the required ink flow and filtering parameters, and the thickness and material of filter 38. The compliance of filter 38 will be essentially inversely proportional to its thickness. The thickness can have any value compatible with the required ink flow and filtering parameters and mechanical strength. It is presently believed that the thickness can be between 10 and 25 $\mu$m, although other thickness values can be used.

For a filter 38 having given dimensions and given ink passage size and spacing, an electroformed nickel filter will have a higher compliance than a stainless steel filter.

Depending on the combination of materials and dimensions chosen for plate 30 and filter 38, it is believed that the compliance of the manifold can be increased by a factor of the order of 140 or more.

It may be noted that, apart from plate 30, the printhead shown in FIG. 1 can be constructed according to techniques and principles already known in the art.

Figure 2:
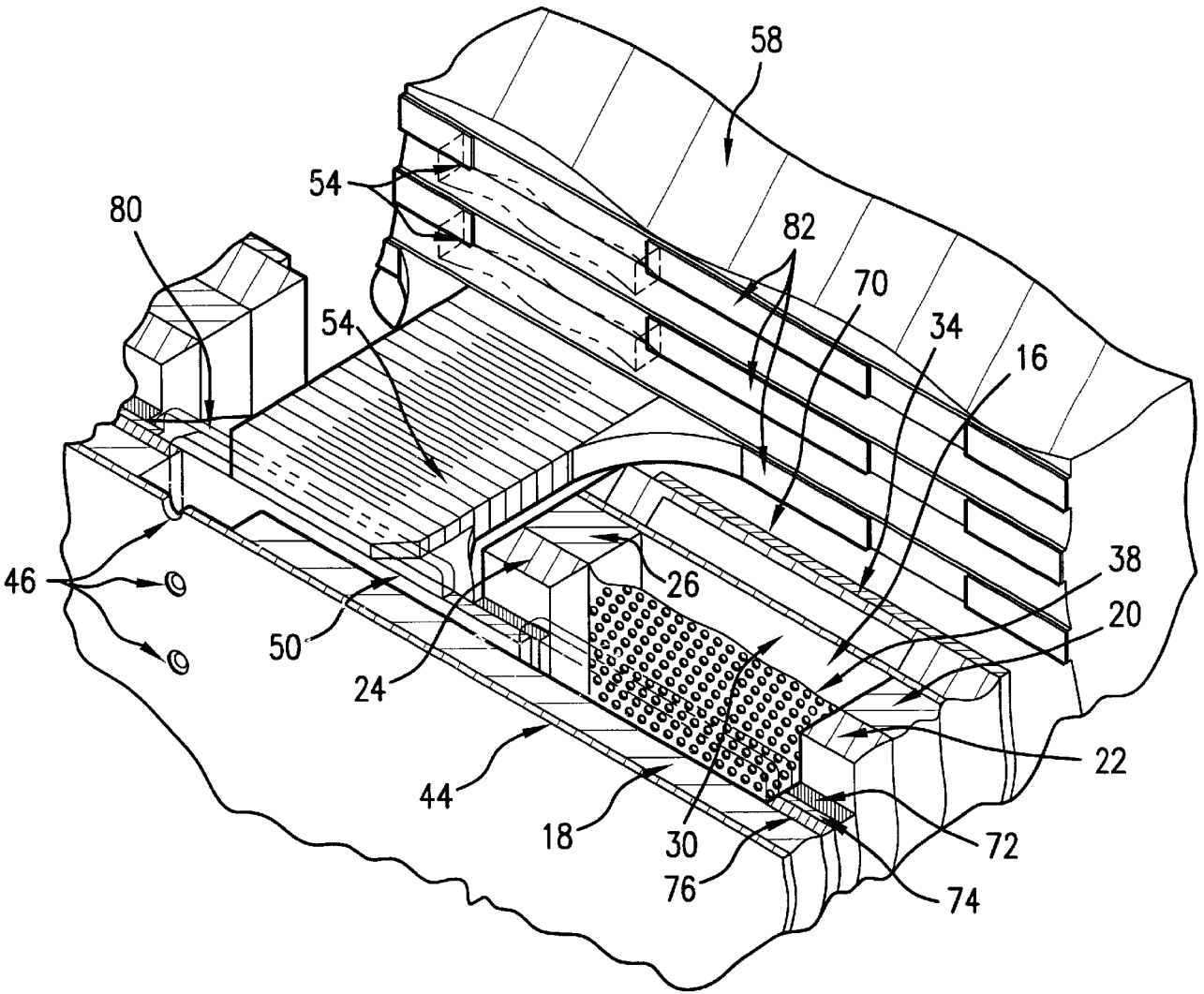
FIG. 2 is a perspective view of the embodiment shown in FIG. 1.

FIG. 2 is a partly cut-away perspective view of the embodiment shown in FIG. 1. Elements already shown in FIG. 1 are identified with the same reference numerals. FIG. 2 illustrates several additional elements which were omitted from FIG. 1 to facilitate an understanding of the basic structure of an ink manifold and ink jet delivery channels according to the invention.

Additional elements that are illustrated in FIG. 2 include a heater 70 which maintains ink at a desired temperature for printing, a bonding plate 72, a further support plate 74 and a restricter plate 76. In addition, FIG. 2 shows a silicone rubber sheet 80 positioned between a transducer 54 and diaphragm 50. Also shown in FIG. 2 are electrodes 82 associated with several transducers 54. All of these elements are, however, conventional in the art.

Figure 3:
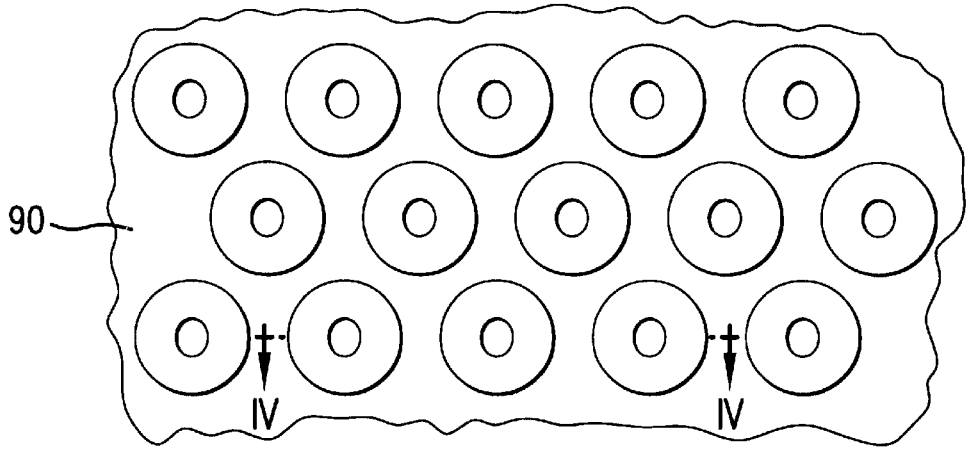
FIG. 3 is a detail plan view of a component of a second embodiment of the invention.
Figure 4:
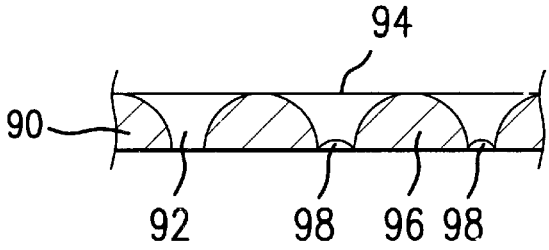
FIG. 4 is a cross-sectional view along line IV—IV of FIG. 3.

According to a second embodiment of the invention, plate 30 can be replaced by a plate 90, as shown in FIGS. 3 and 4. This plate is provided with an array of capillary orifices 92. In the illustrated embodiment, orifices 92 taper from a relatively large diameter at the side 94 of plate 90 which faces ink volume 16 to a small diameter at the side 96 of plate 90 that faces wall 34. However, orifices 92 need not be tapered. As illustrated in FIGS. 1 and 2, an air space exists between wall 34 and plate 30, or plate 90 of FIGS. 3 and 4, and this air space may be vented to the environment.

Each passage 92 is delimited by a surface formed by rotating a generatrix constituted by a quarter circle around the longitudinal axis of the passage. Each passage 92, and particularly the small diameter end thereof, has a sufficiently small diameter that ink present in space 16 will not flow out of passages 92. Ink contained within each passage 92 will form a meniscus 98.

When a pressure disturbance occurs in space 16, it will be attenuated by a variation in the quantity of ink in each passage 92, associated with a change in the position and/or curvature of each meniscus 98. Under normal operating conditions, this variation will not result in the flow of ink into the air space between plate 90 and wall member 34.

The spacing between passages 92 is determined by the compliance that it is desired to provide for space 16. The closer the spacing between passages, the greater will be the resulting compliance. The maximum number of passages 92 is limited essentially only by the surface area of plate 90.

The maximum size of passages 92 is determined by the requirement for the surface tension of meniscus 98 and to prevent meniscus 98 from being pulled back into space 16 in the presence of the normal operating pressure, which may be of the order of 2–3 cm below atmospheric The maximum hole size also depends on the surface tension of the ink. Assuming a surface tension of 30 dyne/cm, these considerations would lead to a maximum radius of about 150 microns at the outlet end of each passage 92.

Since a large number of passages having this size would provide a more than adequate increase in compliance, a practical form of construction of this embodiment could satisfactorily employ smaller diameter passages. The exit diameter of each passage 92 could typically be in the range of 75 to 100 microns.

These passages may be formed in a thin plate by a variety of processes, including etching, drilling, laser drilling, electroforming, piercing, or electro-discharge machining. Passages having the form illustrated in FIGS. 3 and 4 result naturally from using a thin film electroform process.

In normal practice, during priming or purging of a printhead, it is necessary to apply a relatively high positive pressure to the ink in the manifold. In view of this, it may be desirable to provide an additional device which would cover passages 92 while pressure is being applied, in order to prevent ink from leaking out through passages 92.

In further accordance with the invention, plate 90 can be made relatively thin to have a flexibility comparable to that of plate 30 of FIGS. 1 and 2. In this case, a high level of compliance can be provided by a combination of the flexing of plate 90 and the effect produced in capillary passages 92.

Figure 5:
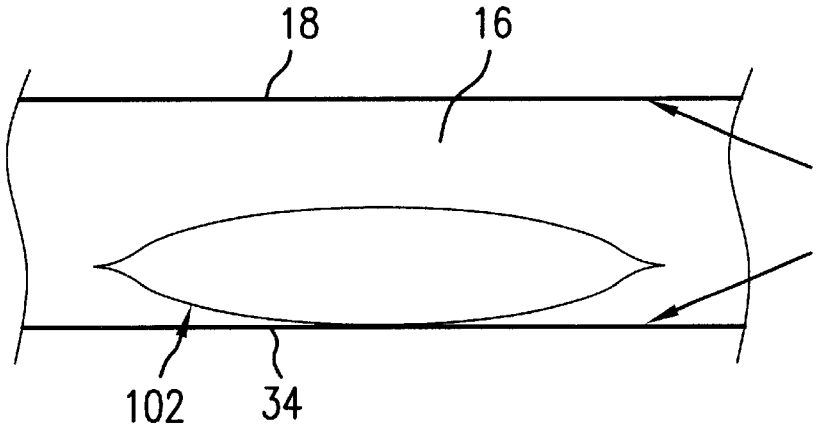
FIG. 5 is a simplified pictorial view of a third embodiment of the invention.

Yet another embodiment of the invention is shown in FIG. 5 which is a simplified, diagrammatic plan view of the interior of a manifold. According to this embodiment, a thin walled air sac 102 may be installed in space 16. Sac 102 is filled with air and may be made of a material which can be made very thin and is chemically compatible with the ink employed in ink jet printers. For some inks, latex rubber may be compatible. Pressure disturbances within space 16 will be attenuated, or dissipated, by compression or expansion of the air within sac 102. The nominal pressure of the air in sac 102 may be equal to or slightly greater than the nominal pressure of ink in space 16. Sac 102 can be made of other materials and can, for example, be a thin-walled metal box made of stainless steel. In the latter form of construction, the nominal pressure within the box can be slightly lower than the nominal pressure of ink in space 16.

It should be appreciated that the embodiment shown in FIG. 5 can be combined with the embodiments of FIGS. 1 and 2 or FIGS. 3 and 4 to provide space 16 with a very high level of compliance with respect to pressure disturbances.

Figure 6:
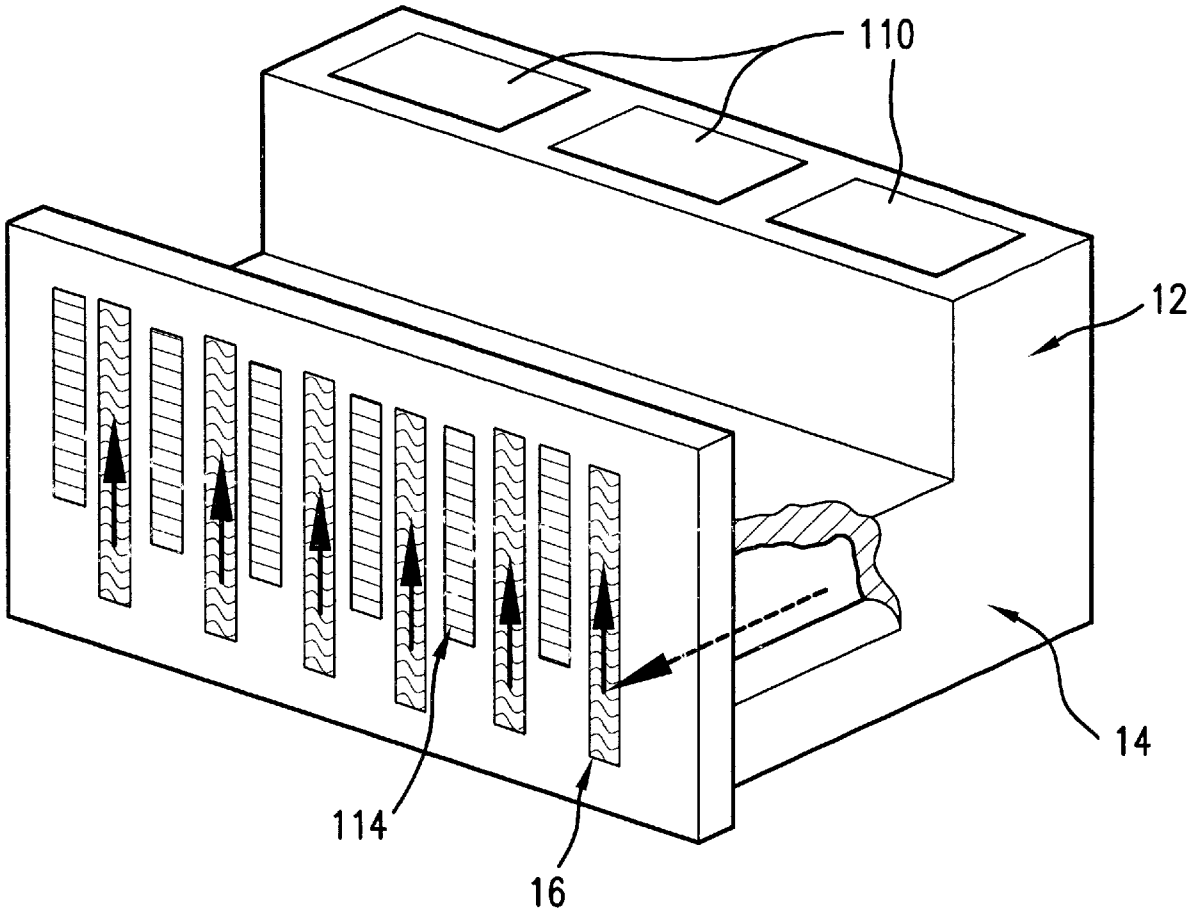
FIG. 6 is a perspective view showing the basic components of a printhead to which the invention may be applied.

FIG. 6 is a respective view showing, in simplified form, the basic physical form of one exemplary printhead which may be equipped with manifolds according to the present invention. This is a color printhead in which reservoir 12 is provided with a plurality of receptacles 110 each for storing a supply of ink of a respectively different color. The printhead includes a plurality of vertical rows of nozzles (not shown), each row being associated with a row of transducers 114. Each transducer corresponds to transducer 54 shown in FIGS. 1 and 2. Adjacent each row of transducers 114 is a respective manifold that contains an ink space 16. Each manifold may be constructed to have the form shown in FIGS. 1 and 2 and/or FIGS. 3 and 4 and may optionally be provided with a sac 102 as shown in FIG. 5. As is conventional in this art, reservoir 12 would lower than the manifolds to maintain a negative pressure at all orifices. Although FIG. 6 shows three receptacles 110 and six rows of nozzles, there can also be provided, in accordance with standard practice in the art, four receptacles and, correspondingly, eight rows of nozzles. As will be apparent to those skilled in the art, the number of rows of nozzles can vary from those mentioned above.

For some printing applications the printhead may be used with reservoirs other than the built-in ones shown e.g. if another orientation of the printhead is required.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ink jet printhead comprising:

a reservoir storing a quantity of printing ink;

at least one ink manifold defining an ink supply volume in communication with said reservoir for holding a supply of ink received from said reservoir; and a plurality of individually controlled ink jet delivery channels, each of said channels having an ink drop ejection transducer and an orifice to eject successive ink drops on demand in response to pressure pulses produced by said transducer, and each of said channels being in communication with said ink supply volume for receiving ink from said ink supply volume, wherein said manifold includes a thin, flexible wall bounding said ink supply volume to provide said ink supply volume a large acoustic compliance to minimize propagation of pressure disturbances in said ink supply volume and acoustic signal crosstalk between said channels, and said wall has a thickness of the order of not more than 12 $\mu$m.

2. The printhead of claim 1 wherein said wall is made of stainless steel.

3. The printhead of claim 2 wherein said ink manifold has an inlet in communication with said reservoir and outlets in communication with said delivery channels, said outlets being spaced from said inlet in an ink flow direction and said wall extending substantially perpendicular to the ink flow direction.

4. The printhead of claim 3 wherein said ink flow volume is delimited by a plurality of surfaces and said wall constitutes one of the surfaces and has an area at least as large as the area of any other one of the surfaces.

5. An ink jet printhead comprising:

a reservoir storing a quantity of printing ink;

at least one ink manifold defining an ink supply volume in communication with said reservoir for holding a supply of ink received from said reservoir; and a plurality of individually controlled ink jet delivery channels, each of said channels having an ink drop ejection transducer and an orifice to eject successive ink drops on demand in response to pressure pulses produced by said transducer, and each of said channels being in communication with said ink supply volume for receiving ink from said ink supply volume, wherein said manifold includes a thin, flexible wall bounding said ink supply volume to provide said ink supply volume a large acoustic compliance to minimize propagation of pressure disturbances in said ink supply volume and acoustic signal crosstalk between said channels, and said ink manifold has an inlet in communication with said reservoir and outlets in communication with said delivery channels, said outlets being spaced from said inlet in an ink flow direction and said wall extending substantially perpendicular to the ink flow direction.

6. The printhead of claim 5 wherein said ink flow volume is delimited by a plurality of surfaces, and said wall constitutes one of the surfaces and has an area at least as large as the area of any other one of the surfaces.

7. An ink jet printhead comprising:

a reservoir storing a quantity of printing ink;

at least one ink manifold defining an ink supply volume in communication with said reservoir for holding a supply of ink received from said reservoir; and a plurality of individually controlled ink jet delivery channels, each of said channels having an ink drop ejection transducer and an orifice to eject successive ink drops on demand in response to pressure pulses produced by said transducer, and each of said channels being in communication with said ink supply volume for receiving ink from said ink supply volume, wherein said manifold includes a thin, flexible wall bounding said ink supply volume to provide said ink supply volume a large acoustic compliance to minimize propagation of pressure disturbances in said ink supply volume and acoustic signal crosstalk between said channels, and said ink supply volume is delimited by a plurality of surfaces, and said wall constitutes one of the surfaces and has an area at least as large as the area of any other one of the surfaces.

8. An ink jet printhead comprising:

a reservoir storing a quantity of printing ink;

at least one ink manifold defining an ink supply volume in communication with said reservoir for holding a supply of ink received from said reservoir; and a plurality of individually controlled ink jet delivery channels, each of said channels having an ink drop ejection transducer and an orifice to eject successive ink drops on demand in response to pressure pulses produced by said transducer, and each of said channels being in communication with said ink supply volume for receiving ink from said ink supply volume, wherein said manifold includes a thin, flexible wall bounding said ink supply volume to provide said ink supply volume a large acoustic compliance to minimize propagation of pressure disturbances in said ink supply volume and acoustic signal crosstalk between said channels, and said thin, flexible wall bounding said ink supply volume includes a plurality of capillary passages which communicate between said ink supply volume and an air space.

9. The printhead of claim 8 wherein said capillary passages are dementioned to be partially filled with ink under normal pressure conditions within said ink supply volume.

10. The printhead of claim 9 wherein each of said capillary passages tapers from a large diameter and communicating with the ink supply volume to a small diameter and communicating with the air space.

11. The printhead of claim 10 wherein the small diameter end of each of said passages has a diameter not greater than 100 microns.

12. An ink jet printhead comprising:

a reservoir storing a quantity of printing ink;

at least one ink manifold defining an ink supply volume in communication with said reservoir for holding a supply of ink received from said reservoir;

a plurality of individually controlled ink jet delivery channels, each of said channels having an ink drop ejection transducer and an orifice to eject successive ink drops on demand in response to pressure pulses produced by said transducer, and each of said channels being in communication with said ink supply volume for receiving ink from said ink supply volume, wherein said manifold includes a thin, flexible wall bounding said ink supply volume to provide said ink supply volume a large acoustic compliance to minimize propagation of pressure disturbances in said ink supply volume and acoustic signal crosstalk between said channels; and a sac filled with air and installed within said ink supply volume.

13. The printhead of claim 12 wherein said sac is made of a material that is compatible with the printing ink.

14. The printhead of claim 13 wherein said sac is made of latex rubber or metal.

* * * * *